US008043140B2

(12) United States Patent
Fujita

(10) Patent No.: US 8,043,140 B2
(45) Date of Patent: Oct. 25, 2011

(54) WAFER POLISHING APPARATUS AND WAFER POLISHING METHOD

(75) Inventor: Takashi Fujita, Mitaka (JP)

(73) Assignee: Tokyo Seimitsu Co., Ltd., Hachioji-shi, Toyko (JP)

( * ) Notice: Subject to any disclaimer, the term of this patent is extended or adjusted under 35 U.S.C. 154(b) by 59 days.

(21) Appl. No.: 12/246,197

(22) Filed: Oct. 6, 2008

(65) Prior Publication Data

US 2009/0042489 A1 Feb. 12, 2009

Related U.S. Application Data

(62) Division of application No. 11/560,952, filed on Nov. 17, 2006, now Pat. No. 7,753,761.

(30) Foreign Application Priority Data

Nov. 24, 2005 (JP) ..... 2005-339257

(51) Int. Cl.
*B24B 1/00* (2006.01)

(52) U.S. Cl. ..... 451/41; 451/56; 451/60

(58) Field of Classification Search ..... 451/41, 451/60, 443, 444, 56, 63
See application file for complete search history.

(56) References Cited

U.S. PATENT DOCUMENTS

| | | | |
|---|---|---|---|
| 4,102,299 | A | 7/1978 | Wallstén |
| 4,222,342 | A | 9/1980 | Johansson et al. |
| 4,907,426 | A | 3/1990 | Wood et al. |
| 5,486,131 | A | 1/1996 | Cesna et al. |
| 5,868,863 | A | 2/1999 | Hymes et al. |
| 5,885,147 | A | 3/1999 | Kreager et al. |
| 5,928,062 | A | 7/1999 | Miller et al. |
| 6,139,406 | A | 10/2000 | Kennedy et al. |
| 6,193,587 | B1 | 2/2001 | Lin et al. |
| 6,224,470 | B1 | 5/2001 | Hoey et al. |
| 6,280,299 | B1 | 8/2001 | Kennedy et al. |
| 6,284,092 | B1 | 9/2001 | Manfredi |
| 6,358,124 | B1 | 3/2002 | Koga et al. |

(Continued)

FOREIGN PATENT DOCUMENTS

JP 10-296618 A 11/1998

(Continued)

OTHER PUBLICATIONS

Optimization of CMP Pad Groove Arrays for Improved Slurry Transport, Wafer Profile Correction, and Defectivity Reduction; Gregory P. Muldowney, Advanced Research Group Rohm and Haas Electronic Materials CMP Technologies, Newark, DE 19713 USA; Feb. 23-25, 2005 CMP-MIC Conference 2005 IMIC-1000P/C/0156; pp. 156-167.

(Continued)

*Primary Examiner* — Maurina Rachuba
(74) *Attorney, Agent, or Firm* — Roberts Mlotkowski Safran & Cole, P.C.; David S. Safran

(57) ABSTRACT

A wafer polishing in which a polishing liquid is supplied to a polishing pad for polishing a wafer carried on a carrier head; and the polishing liquid is supplied from one or more polishing liquid supplying devices onto the polishing pad, by a polishing liquid supplying member of the polishing liquid supplying device being positioned close to or in contact with the polishing pad, and is relatively moved against the polishing pad, so that the polishing liquid supplied to the upper portion of the polishing liquid supplying member flows down along the polishing liquid supplying member to be painted on a surface of the polishing pad.

8 Claims, 9 Drawing Sheets

U.S. PATENT DOCUMENTS

| | | | |
|---|---|---|---|
| 6,398,627 | B1 | 6/2002 | Chiou et al. |
| 6,551,174 | B1 | 4/2003 | Brown et al. |
| 6,762,135 | B2 | 7/2004 | Yang et al. |
| 6,846,227 | B2 | 1/2005 | Sato et al. |
| 2002/0119613 | A1 | 8/2002 | Yang et al. |
| 2003/0190874 | A1 | 10/2003 | So |
| 2005/0070215 | A1 | 3/2005 | Kim |

FOREIGN PATENT DOCUMENTS

| | | | |
|---|---|---|---|
| JP | 11-277411 | A | 10/1999 |
| JP | 2000-153460 | A | 6/2000 |
| JP | 2002-355759 | A | 12/2002 |
| JP | 2003-220554 | A | 8/2003 |
| JP | 2004-63888 | A | 2/2004 |
| JP | 2006-147773 | A | 6/2006 |
| KR | 2005005959 | A | 1/2005 |

OTHER PUBLICATIONS

Japanese Office Action Corresponding to This Case Was Issued on Jun. 9, 2010 From the Japanese Patent Office. English Translation Attached.

WAFER POLISHING APPARATUS AND WAFER POLISHING METHOD

CROSS REFERENCE TO RELATED APPLICATION

This application is a divisional of commonly owned, co-pending U.S. patent application Ser. No. 11/560,952, filed Nov. 17, 2006.

BACKGROUND OF THE INVENTION

1. Field of the Invention

The present invention relates to a wafer polishing apparatus for chemical mechanical polishing, and a wafer polishing method.

2. Description of the Related Art

Wafers for semiconductor equipments and electronic components are manufactured through processings including cutting, polishing, and the like. Recently, development of semiconductor technology has promoted miniaturization and multi-layer wiring in a design rule for semiconductor integrated circuit, and larger diameter wafers have been used from the view of reducing costs. In such a context, when a pattern layer is formed on a previous pattern layer in a conventional way, due to the concavo-convex profile of the previous pattern layer, it is difficult to form an accurate pattern thereon, which often leads to defects.

So, a planarization process has been used to planarize a surface of a pattern formed layer before another pattern layer is formed thereon. In the planarization process, frequently chemical mechanical polishing (CMP) is used. When a wafer is polished in chemical mechanical polishing, a wafer carrier head carries the wafer and holds the wafer against a rotating polishing pad at a predetermined pressure, and then a polishing liquid such as slurry or chemical is supplied between the polishing pad and the wafer.

In the polishing by chemical mechanical polishing, a polishing liquid supplied onto the polishing pad is a significant factor which influences the result of polishing, and a consistent supply of a polishing liquid to a polishing pad is required to uniformly polish wafers.

Because an oversupply of a polishing liquid increases the cost for polishing, a consistent supply of a polishing liquid needs to be effectively performed by a small amount of a polishing liquid to a polishing pad.

Conventionally, to address the above problem, grooves are formed in a polishing pad to effectively distribute a polishing liquid over an entire surface of the polishing pad, and the grooves are in shapes having various designs (see a document: G. P. Muldowney, Optimization of CMP Pad Groove Arrays for Improved Slurry Transport, Wafer Profile Correction, and Defectivity Reduction, Proceeding of CMP-MIC (2005). pp 156-167).

However, a polishing liquid needs to be transported to a surface of a polishing pad, not into the grooves, for polishing. Therefore, there has been a need for a method to effectively supply a polishing liquid to a surface of a polishing pad, not into grooves formed in the polishing pad.

In order to address the problem, apparatuses such as a wafer polishing apparatus in which a position to supply a polishing liquid can be changed by using a movable arm, and a polishing apparatus in which a polishing liquid is sprayed in a form of mist and a squeegee is provided to spread the polishing liquid on a surface to be polished have been suggested (for example, see Japanese Patent Application Laid-Open No. 2004-63888, Japanese Patent Application Laid-Open No. 11-70464, and Japanese Patent Application Laid-Open No. 10-296618).

SUMMARY OF THE INVENTION

However, in all of the technologies described in the above patent documents, a polishing liquid is pressed and spread between a wafer and a polishing pad, or a polishing pad and a squeegee so that the polishing liquid can be distributed to an entire surface of the polishing pad. Since the polishing liquid is supplied through grooves which are formed in the polishing pad, the polishing liquids spreads out differently depending on the number of rotation of the polishing pad, a pressure between the wafer and the pad, and a design of groove arrays, and so it is difficult to uniformly supply the polishing liquid to the entire surface of the polishing pad, which may cause problems such as scratch on a surface to be polished.

When a polishing liquid is spread to an entire surface of a polishing pad, some polishing liquid comes out of grooves formed in the polishing pad to be involved in polishing, but some polishing liquid are discharged from the polishing pad without being involved in polishing to be a wasted consumption of polishing liquid.

In addition, polishing residues including pad debris generated in polishing, coarse abrasive grains, polishing debris, and the like are mixed into a new polishing liquid when the polishing residues are discharged from the grooves on a polishing pad to exterior, thereby the mixed polishing residues causes scratches on a surface to be polished. This problem can be reduced by supplying a large amount of polishing liquid, but this consumes an excess amount of polishing liquid, and considerably increases the cost.

Furthermore, in polishing wafers by CMP, a polishing pad needs to be regularly dressed in order to prevent lowering of a polishing rate due to any clogging of the pad. The dressing roughens a surface of the polishing pad and abrades the surface of the polishing pad, resulting in a greatly different depth of the grooves of the polishing pad after a long time of use compared to the depth at an initial use. This in turn causes a difference in the way the polishing liquid spreads out after a long time of use compared to the way at an initial use, which adversely influences the polishing quality.

In addition to the above problems, in the technologies described in the above patent documents, when the amount of a polishing liquid to be supplied from a nozzle is reduced, the polishing liquid remains at a tip end of the nozzle and may discontinuously drop onto a surface of a polishing pad. This causes a problem which prevents a uniform spread of polishing liquid over the entire surface of the polishing pad.

The present invention was made in view of the above problems, and one object of the present invention is to provide a wafer polishing apparatus and a wafer polishing method in which a polishing liquid, even in a small amount, can be uniformly supplied onto a polishing pad by a supplying member of a simple configuration to accurately polish wafers.

In order to achieve the above object, a first aspect of the present invention provides a wafer polishing apparatus which comprises: a polishing pad to which a polishing liquid is supplied for polishing a wafer; a carrier head to carry the wafer; and one or more polishing liquid supplying device which supplies the polishing liquid onto the polishing pad, and the polishing liquid supplying device has a polishing liquid supplying member which is positioned close to or in contact with the polishing pad and is relatively moved against the polishing pad, so that the polishing liquid supplied to the upper portion of the polishing liquid supplying member flows down along the polishing liquid supplying member to be painted on a surface of the polishing pad.

According to the first aspect according to the present invention, a polishing liquid supplying device has a polishing liquid supplying member, and the polishing liquid supplying member is disposed with a tip end thereof being close to or in contact with a polishing pad which is polishing a wafer carried by a carrier head. In this condition, slurry or chemical as a polishing liquid is uniformly supplied to an upper portion of polishing liquid supplying member.

The polishing liquid, after being supplied to the upper portion of polishing liquid supplying member, flows down along the polishing liquid supplying member. The flowing down polishing liquid, even in a small amount, uniformly spreads out on the polishing pad due to interfacial tension between the polishing pad and the polishing liquid supplying member, and the rotation of the polishing pad and the movement of the polishing liquid supplying member allow the polishing liquid to be uniformly painted on the surface of the polishing pad.

In the present invention, "paint" is defined as "a method of transferring a liquid from the surface of one object to the surface of another object in close enough to form no droplet by use of an effect of capillarity". Also, "an effect of capillarity" is defined as "a phenomenon such as a liquid transfer by an interfacial tension between a solid and a liquid" herein. The effect of capillarity in here is used in the broad sense which is exemplified by such phenomena: a liquid transfers in a small diameter tube; a liquid transfers via a surface of a brush; a liquid transfers (permeates) into a foamed material; and an ink runs along a groove of a fountain pen. All the phenomena cited above show that a liquid is transferred along the solid surface/interface.

Therefore, the definition of "paint" in the present invention includes the following situations: a liquid which permeates a brush-like member is supplied ("painted") to the surface of another solid object in close enough to form no droplet; a liquid which permeates a foamed material is supplied ("painted") to the surface of another solid object in close enough to form no droplet; a liquid which runs along grooves formed on a plate is supplied ("painted") to the surface of another solid object in close enough to form no droplet; and an ink which is filled in a fountain pen is supplied ("painted") on a paper.

Now, an outline of interfacial tension is described below. An interface is a surface between two phases which are not mixed to each other. Herein, there are three phases: gas phase, liquid phase, and solid phase. So, an interface between two phases includes interfaces which are formed between gas phase and liquid phase, liquid phase and solid phase, solid phase and gas phase, two liquid phases, and two solid phases. The interfacial tension can be defined as a force which acts to minimize an area of such an interface. While, there is a general term "surface tension", and this surface tension is one kind of the interfacial tension which is generated at an interface between two phases, one of which is gas phase.

Water, which is used as a main component of cleaning liquids and the like, is one of liquids which have an extremely high surface tension, thereby a large size of water droplet can be formed. The same is true in the water behavior of forming a large droplet in supplying of polishing liquid of slurry and the like which is a mixture of abrasive grains and water.

As shown in FIGS. 10A to 10C, when a polishing liquid is dropped from a nozzle, a droplet of the polishing liquid is formed at a tip end of the nozzle by surface tension, and a droplet having a predetermined size or more falls. Thus, when a continuous supply of a small amount of a polishing liquid is desired, it is difficult to continuously supply the polishing liquid because no droplet falls until it has a predetermined size or more due to the surface tension of the polishing liquid. So this causes a serious problem.

In conventional apparatuses, as shown in FIG. 11A, when a small amount of a polishing liquid is supplied from a nozzle, because the supplied polishing liquid does not immediately contact with a polishing pad which provides a solid surface and only surface tension of the polishing liquid is effective, it is difficult that the polishing liquid forms a droplet and is continuously supplied.

In a wafer polishing apparatus and a wafer polishing method according to the present invention, as shown in FIG. 11B, because a polishing liquid supplying member is close to or in contact with a polishing pad, before a polishing liquid could forms a droplet, the polishing liquid contacts the polishing pad. Interfacial tension individually acts on the polishing liquid which has contacted with the polishing pad to spread the polishing liquid over the polishing pad. This allows the polishing liquid, even in an extremely small amount, to occupy a large surface area: in other words, it allows the amount of the polishing liquid which is required for a uniform supply over a certain surface area to be reduced.

Thus, a small amount of slurry or chemical can be uniformly painted on a polishing pad without causing any problem to a wafer surface to be polished such as scratch, resulting in an accomplishment of polishing of wafers at low cost with high accuracy.

A second aspect of the present invention according to the first aspect provides the wafer polishing apparatus, wherein the polishing liquid supplying device is disposed at a position located from a central portion toward a peripheral portion of the polishing pad in a radial direction of the polishing pad.

According to the second aspect according to the present invention, the position of the polishing liquid supplying member facilitates a contact or a close proximity between the polishing liquid supplying member and an entire surface of the polishing pad, and increases the area to which a polishing liquid is painted. This ensures a uniform painting of a polishing liquid on an entire surface of the polishing pad.

A third aspect of the present invention according to the first aspect or second aspect provides the wafer polishing apparatus, wherein the polishing liquid supplying member is a plate-like member which has a plurality of grooves formed therein, or a brush-like member which is formed by binding a plurality of thread-like members.

According to the third aspect according to the present invention, the polishing liquid supplying member is a flexible plate-like member which has a plurality of grooves formed therein, or a brush-like member which is formed by binding a plurality of thread-like members. When a polishing liquid is uniformly supplied to an upper portion of the plate-like member or brush-like member, the polishing liquid uniformly flows down to the polishing pad because of an effect of capillarity which is generated by interfacial tension between the plate-like member or brush-like member and the fluid. When the polishing liquid supplying member is in contact with the polishing pad, the pressure applied to the polishing pad can be adjusted by changing the position of the polishing liquid supplying member in the height direction thereof.

A fourth aspect of the present invention according to one of the first aspect to the third aspect provides the wafer polishing apparatus, wherein the polishing liquid supplying member is positioned so that the polishing liquid supplying member is close to or in contact with the polishing pad and the polishing liquid which flows down along the polishing liquid supplying member does not contact with a bottom of a groove which is formed in the polishing pad.

According to the fourth aspect according to the present invention, the polishing liquid supplying member has a tip end which is in contact with a surface of the polishing pad to prevent the polishing liquid from forming a droplet and stopping its flow, or is close to a surface of the polishing pad to prevent the polishing liquid from forming a droplet.

However, the polishing pad has a groove formed therein which is not directly involved in a polishing operation but is used for the discharge of old polishing liquid and polishing debris, and between a bottom of such a groove and the tip end of polishing liquid supplying member, there is a distance which is long enough for a droplet of the polishing liquid to be formed due to surface tension of the polishing liquid. So, the polishing liquid is formed into a droplet above the groove, which will not be directly supplied to the bottom of the groove from the polishing liquid supplying member. This allows the polishing liquid to be effectively supplied only to the surface of the polishing pad.

A fifth aspect of the present invention according to one of the first aspect to the fourth aspect provides the wafer polishing apparatus, wherein the polishing liquid supplying device is provided with a polishing liquid supply tube for supplying a polishing liquid to the polishing liquid supplying member, and the polishing liquid supply tube has a side surface in which a horizontal slit is formed, and is configured to reserve an amount of the polishing liquid therein and supply the polishing liquid which flows out of the slit to the polishing liquid supplying member which is placed in contact with the slit when the reserved polishing liquid exceeds the amount.

According to the fifth aspect according to the present invention, the polishing liquid flows into the polishing liquid supply tube to be reserved therein. When the top position of the reserved polishing liquid exceeds the position of the slit which is horizontally formed in a side surface of the polishing liquid supply tube, the polishing liquid flows out of the slit to the outside of the polishing liquid supply tube. Because the flowing out polishing liquid has a surface which is evenly raised, resulting in a uniform flow of the polishing liquid out of the entire slit. Then, the flowing out polishing liquid contacts with the polishing liquid supplying member which is placed in contact with the slit, and then flows down along the polishing liquid supplying member to be painted on the polishing pad.

A sixth aspect of the present invention according to one of the first aspect to the fifth aspect provides the wafer polishing apparatus, wherein the polishing liquid supply tube is provided with a tilt sensor for measuring an angle of tilt of the polishing liquid supply tube.

According to the sixth aspect according to the present invention, since an angle of tilt of the polishing liquid supply tube can be measured, any uneven supply of polishing liquid to the polishing supplying member due to a tilted surface of the reserved polishing liquid to the slit which is caused by a tilt of the polishing liquid supply tube, can be prevented. Therefore, the polishing liquid can be consistently uniformly supplied to polishing liquid supplying member.

A seventh aspect of the present invention according to one of the first aspect to the sixth aspect provides the wafer polishing apparatus, wherein the polishing liquid supplying member is formed of a polymeric resin material.

According to the seventh aspect according to the present invention, the polishing liquid supplying member is formed of a flexible polymeric resin material, so that the polishing liquid supplying member can contact with the polishing pad with a properly applied load without damaging a surface of the polishing pad.

An eighth aspect of the present invention according to one of the first aspect to the seventh aspect provides the wafer polishing apparatus, further comprising a cleaning device for cleaning the polishing liquid supplying member after the supply of the polishing liquid.

According to the eighth aspect according to the present invention, the polishing liquid supplying member after the supply of the polishing liquid is cleaned using pure water to prevent any adhering of the polishing liquid thereon.

A ninth aspect of the present invention provides a wafer polishing method, comprising: positioning one or more polishing liquid supplying member close to or in contact with a polishing pad which polishes a wafer, and relatively moving the polishing liquid supplying member against the polishing pad, the polishing liquid supplying member being formed of a plate-like member in which a groove is formed or a brush-like member which is formed by binding a plurality of thread-like members; and supplying a polishing liquid to an upper portion of the polishing liquid supplying member so that the polishing liquid flows down along polishing liquid supplying member onto a surface of the polishing pad for polishing a wafer.

According to the ninth aspect according to the present invention, the polishing liquid is supplied to an upper portion of the polishing liquid supplying member which is close to or in contact with the polishing pad, so that the polishing liquid flows down along the polishing liquid supplying member to be spread over the polishing pad due to the interfacial tension acting between the polishing pad and the polishing liquid supplying member. Thus, the polishing liquid, even in a small amount, can be uniformly spread out without causing any problem to a wafer surface to be polished such as scratch, resulting in an accomplishment of polishing of a wafer at low cost with high accuracy.

A tenth aspect of the present invention according to the ninth aspect provides the wafer polishing method, further comprising: removing polishing residues on the polishing pad by the polishing liquid supplying member in contact with the polishing pad, during the step of supplying a polishing liquid to an upper portion of the polishing liquid supplying member so that the polishing liquid flows down along polishing liquid supplying member onto a surface of the polishing pad.

According to the tenth aspect according to the present invention, polishing residues including pad debris, coarse abrasive grains, polishing debris or the like remained on the polishing pad are removed by the polishing liquid supplying member, by adjusting the contact pressure applied to polishing pad by the polishing liquid supplying member. In this removing of polishing residues, a new polishing liquid is supplied onto the polishing liquid supplying member, to be uniformly painted on the surface of the polishing pad which has been cleaned by the polishing liquid supplying member.

An eleventh aspect of the present invention according to the ninth aspect provides the wafer polishing method, further comprising: dressing the polishing pad by a pad dresser which is provided to the polishing liquid supplying member at a portion where the polishing liquid supplying member is in contact with the polishing pad for dressing the polishing pad, during the step of supplying a polishing liquid to an upper portion of the polishing liquid supplying member so that the polishing liquid flows down along polishing liquid supplying member onto a surface of the polishing pad.

According to the eleventh aspect according to the present invention, a dresser for dressing the polishing pad is provided at a portion where the polishing liquid supplying member is in contact with the polishing pad. In this configuration, by adjusting the contact pressure applied by the polishing liquid supplying member to the polishing pad, the polishing pad can be dressed. In this dressing, a new polishing liquid is supplied to an upper portion of the polishing liquid supplying member to be uniformly painted on the surface of the polishing pad which has been dressed by the polishing liquid supplying member.

In this way, a new polishing liquid is uniformly painted on a new surface of the polishing pad immediately after the dressing, which enables a high quality and high accuracy polishing of a wafer to be performed.

As described above, according to a wafer polishing apparatus and a wafer polishing method of the present invention, a polishing liquid supplying member having a simple configuration allows a polishing liquid, even in a small amount, to be uniformly painted on a polishing pad by using interfacial tension of the polishing liquid. This enables a polishing of a wafer to be performed at low cost with high accuracy without causing any problem such as scratch to a wafer surface to be polished.

DETAILED DESCRIPTION OF THE PREFERRED EMBODIMENTS

Now, a preferred embodiment of a wafer polishing apparatus and a wafer polishing method according to the present invention will be explained in detail below by way of the accompanying drawings.

Figure 1:
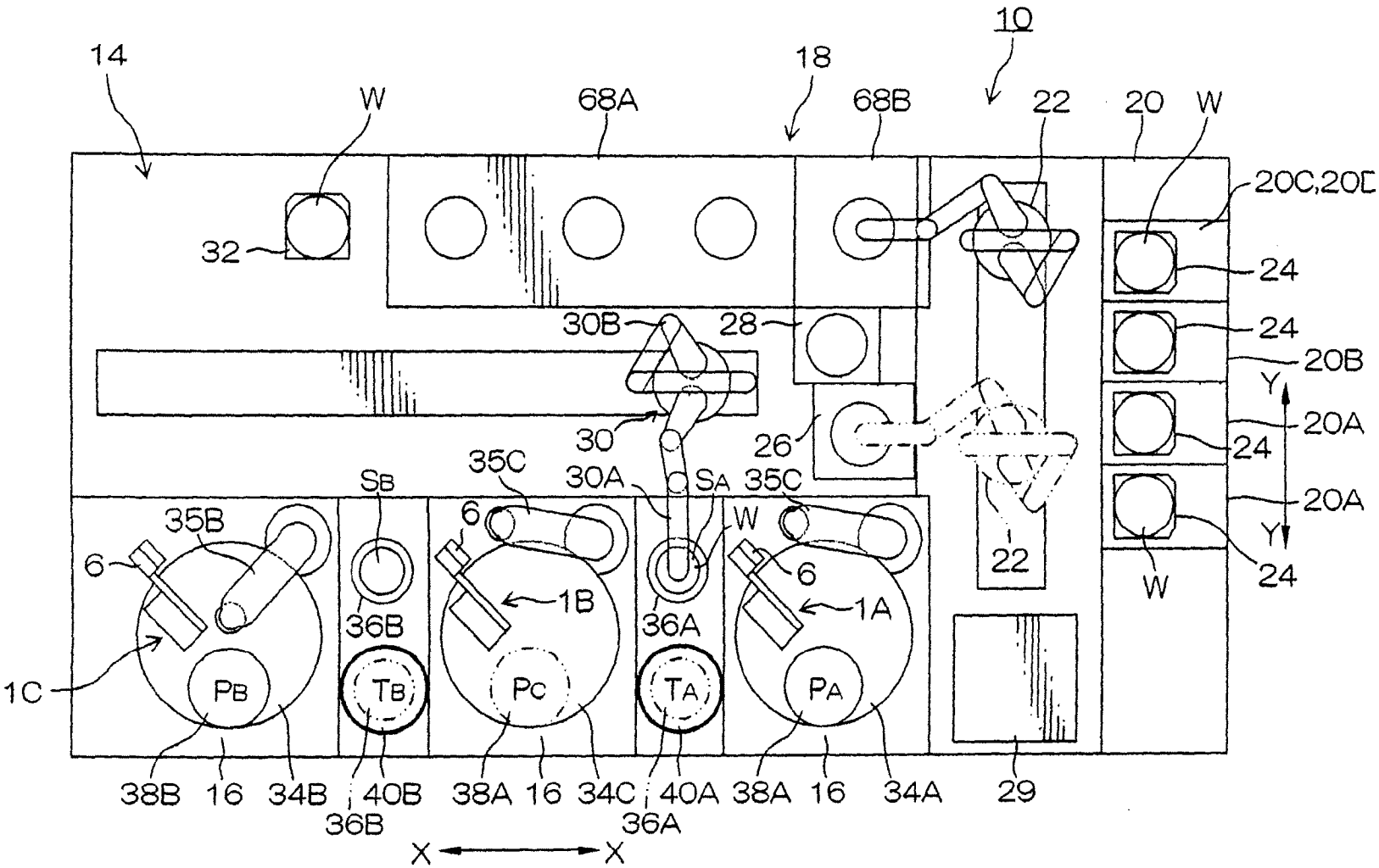
FIG. 1 is a view showing an entire structure of a wafer polishing apparatus according to the present invention.

First, a configuration of a wafer polishing apparatus according to the present invention will be explained. FIG. 1 is a view showing an entire structure of a wafer polishing apparatus 10.

As shown in FIG. 1, a chemical mechanical polishing apparatus 10 of this embodiment includes a wafer housing section 20, a transporting device 14, polishing devices 16 which are polishing sections, a cleaning and drying device 18, film thickness measuring devices, and an apparatus controlling section (not shown). The wafer housing section 20 includes product wafer housing sections 20A, a dummy wafer housing section 20B, a first monitor wafer housing section 20C, and a second monitor wafer housing section 20D, and in each section, wafers S are housed with being stored in a cassette 24. There are the two product wafer housing sections 20A side by side. A lower portion of a cassette 24 provides the first monitor wafer housing section 20C, and an upper portion of the cassette 24 provides the second monitor wafer housing section 20D.

The transporting device 14 includes an indexing robot 22, a transfer robot 30, and transport units 36A and 36B. The indexing robot 22 has two rotatable and bendable arms, and is movably provided in a direction shown by an arrow Y of FIG. 1. The indexing robot 22 takes out a wafer W to be polished from a cassette 24 which is placed in each wafer housing section to transport the wafer W to the wafer stand-by positions 26 and 28, and also receives a wafer W after cleaning from the cleaning and drying device 18 to store in a cassette 24.

The transfer robot 30 has a rotatable and bendable loading arm 30A and an unloading arm 30B, and is movably provided in a direction shown by an arrow X of FIG. 1. The loading arm 30A is used for a transportation of a wafer W before polishing: the loading arm 30A receives a wafer W before polishing by using a pad (not shown) provided at a tip end of the loading arm 30A from the wafer stand-by positions 26 and 28 to transport the wafer W to the transport units 36A, 36B.

Meanwhile, the unloading arm 30B is used for a transportation of a wafer W after polishing: the unloading arm 30B receives a wafer W after polishing by using a pad (not shown) provided at a tip end of the unloading arm 30B from the transport units 36A, 36B to transport the wafer W the cleaning and drying device 18.

Both of the transport units 36A and 36B are movably provided in a direction shown by the arrow Y of FIG. 1, and move between receipt positions SA, SB and delivery positions TA, TB. At the receipt positions SA and SB, the transport units 36A and 36B receive a wafer W to be polished from the loading arm 30A of the transfer robot 30, and then move to the delivery positions TA and TB to deliver the wafer to the polishing heads 38A and 38B, respectively. After polishing, the transport units 36A and 36B receive the wafer W at the delivery positions TA and TB, and then move to the receipt positions SA and SB to deliver the wafer W to the unloading arm 30B of the transfer robot 30.

The transport units 36A, 36B have individually two tables, and the two tables are separately used for resting a wafer W before polishing and a wafer W after polishing. Next to the cleaning and drying device 18, an unloading cassette 32 is provided to be used for temporarily storing a wafer after polishing. For example, while the cleaning and drying device 18 is not operated, a wafer W after polishing is transported to the unloading cassette 32 by the transport robot 30 for a temporal storing.

The polishing devices 16 polishes wafers and, as shown in FIG. 1, include polishing tables 34A, 34B, and 34C, wafer carrier heads 38A and 38B, polishing liquid supplying devices 1A, 1B, and 1C, and carrier cleaning units 40A and 40B. The polishing tables 34A, 34B, and 34C have a disc-like shape, and are disposed in a line. Each of the polishing tables 34A, 34B, and 34C has an upper surface to which a polishing pad is attached. The polishing liquid supplying devices 1A, 1B, and 1C supply a polishing liquid such as slurry and chemical to the polishing pads.

Among the three polishing tables 34A, 34B, and 34C, the right and left polishing tables 34A and 34B are used to polish a first film to be polished (e.g., a Cu film), while the center polishing table 34C is used to polish a second film to be polished (e.g., a Ta film). Depending on the film to be polished, types of polishing liquid to be supplied, the number of rotation of a polishing head, the number of rotation of a polishing table, as well as a holding down pressure of the polishing head, a material of a polishing pad, and the like are changed.

Near the polishing tables 34A, 34B, and 34C, dressing apparatuses 35A, 35B, and 35C are provided individually. The dressing apparatuses 35A, 35B, and 35C individually have a rotatable arm which is provided with a dresser at a tip end thereof to dress a polishing pad on the polishing tables 34A, 34B and 34C.

There are provided two wafer carrier heads 38A and 38B which are movable in a direction shown by the arrow X of FIG. 1.

Figure 2:
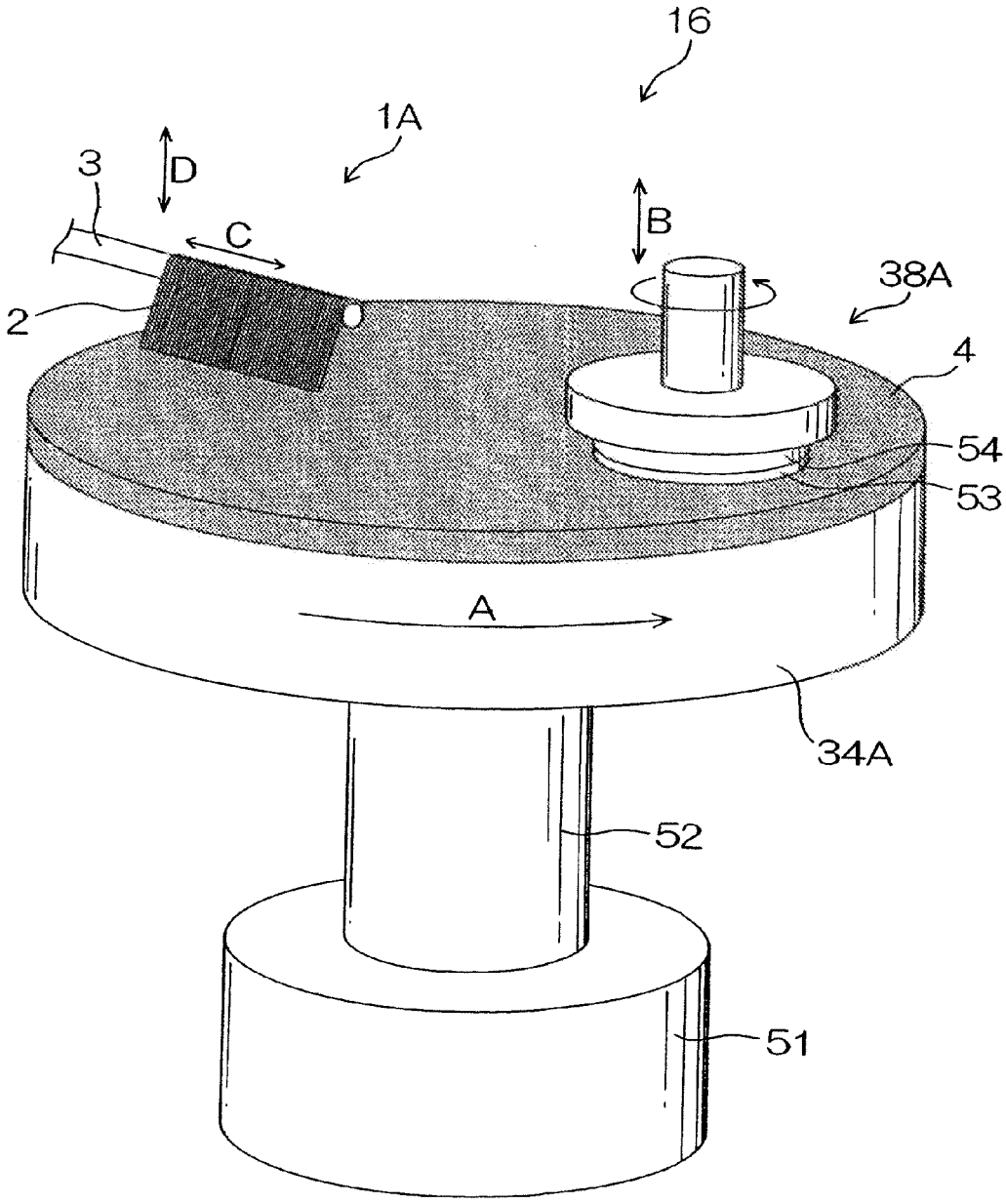
FIG. 2 is a perspective view showing a structure of a polishing device.

FIG. 2 is a perspective view showing a structure of a polishing device 16 which is a polishing section. As shown in FIG. 2, the polishing device 16 includes a polishing table 34A on which a polishing pad 4 is mounted.

The polishing table 34A is coupled to a shaft 52, at a lower part thereof, which is coupled to an output shaft (not shown) of a motor 51, so that a driving of the motor 51 causes the polishing table 34A to rotate in a direction shown by an arrow A.

The wafer carrier head 38A has a guide ring 54, a retainer ring 53, and the like at a lower portion thereof, and in an inside portion thereof, a carrier (not shown) to which a wafer is adsorbed and immobilized is provided. The wafer carrier head 38A is moved in a direction shown by an arrow B by a moving mechanism (not shown), and presses the immobilized wafer against the polishing pad 4 under a pressure.

Figure 3:
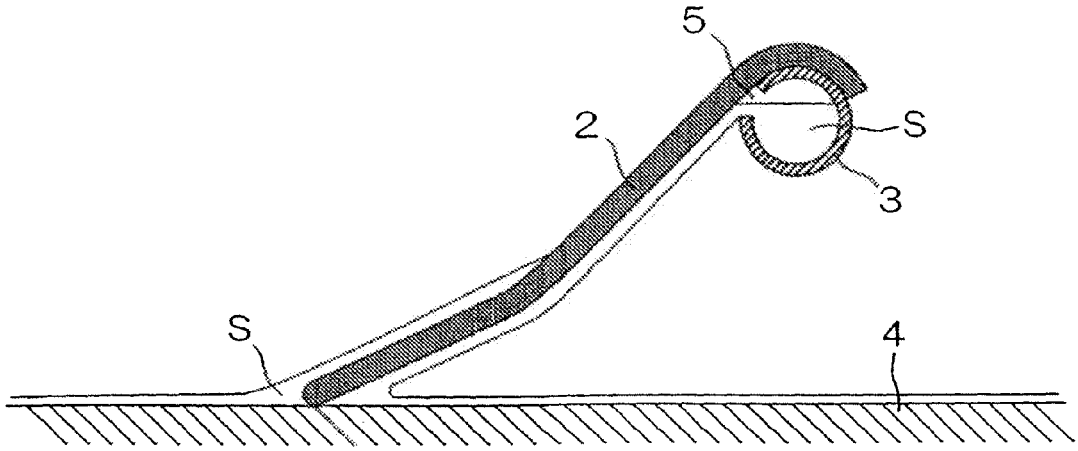
FIG. 3 is a side cross sectional view showing a polishing liquid supplying member and a polishing liquid supply tube.

The polishing liquid supplying device 1A has, as shown in FIG. 3, a polishing liquid supplying member 2 and a polishing liquid supply tube 3, and is radially disposed at a position located from a central portion to a peripheral portion of the polishing pad. The polishing liquid supply tube 3 has a side surface in which a horizontal slit 5 is formed, and the polishing liquid supplying member 2 is placed in contact with the slit 5.

The polishing liquid supplying device 1A is movable in a direction shown by an arrow C or in a direction shown by an arrow D by a moving mechanism (not shown), and the polishing liquid supply tube 3 is provided with a tilt sensor 6 at one end 1 thereof which measures an angle of tilt of the polishing liquid supply tube 3. The tilt sensor may preferably be a linear tilt sensor DSR-LO2-15 by Omron Corporation, for example.

The polishing liquid supply tube 3 is formed of a tubular member, and has a side surface in which a slit is formed to be parallel to the polishing pad 4 and two ends, with one end being closed and the other being open to be supplied with a polishing liquid for polishing from a polishing liquid tank (not shown) by using a pump (not shown).

The polishing liquid supplied to the polishing liquid supply tube 3, as shown in FIG. 3, is reserved inside of the polishing liquid supply tube 3. When the quantity of the reserved polishing liquid exceeds a certain amount, the polishing liquid flows out of the slit 5 and flows down along the polishing liquid supplying member 2 to be painted on the polishing pad 4.

The polishing liquid supplying member 2 is formed of a plate-like member having a groove formed on the surface, or a brush-like member which is formed by binding a plurality of thread-like members. In polishing, the polishing liquid supplying member 2 is disposed so close to the polishing pad 4 that a droplet of the polishing liquid cannot be formed by surface tension of the polishing liquid at a tip end of the polishing liquid supplying member 2. Alternatively, the polishing liquid supplying member 2 is disposed in contact with the polishing pad 4.

In the above described configuration, when a polishing liquid is uniformly supplied from the polishing liquid supply tube 3 which is positioned at an upper portion of the polishing liquid supplying member 2, the polishing liquid uniformly flows down along the polishing liquid supplying member 2 because of an effect of capillarity which is generated by interfacial tension between the plate-like member or brush-like member and the fluid. After the flowing down, the polishing liquid, even in a small amount, is uniformly spread out over the polishing pad 4 due to interfacial tension between the polishing pad 4 and the polishing liquid supplying member 2, and is uniformly painted on a surface of the polishing pad 4 by using the rotation of the polishing pad 4 and the movement of the polishing liquid supplying member 2.

There is a space between the tip end of the polishing liquid supplying member 2 and a bottom of a groove formed in the polishing pad 4 which is larger than a size of a droplet when a droplet of the polishing liquid is formed due to surface tension. So, the polishing liquid is not directly supplied to the bottom of a groove, but effectively painted only to the surface of the polishing pad 4.

The plate-like member or brush-like member used as the polishing liquid supplying member 2 is formed of a polymeric resin material such as polyamide, polyethylene, polyacetal, and polyester, and is flexible. Thus, when the polishing liquid supplying member 2 contacts the polishing pad 4, the polishing liquid supplying member 2 bends depending on the contact pressure applied by the polishing pad 4, and presses back the surface of the polishing pad 4 under a pressure.

Other than the brush-like member or a brushing member, any member which is capable of holding a liquid over a wide area by utilizing capillarity may be used as a preferable polishing liquid supplying member.

For example, a foamed material such as foamed polyurethane and PVA sponge can be a preferable polishing liquid supplying member. When a foamed material is used, a liquid is absorbed into air gaps which are formed in the material so that the surface tension of the liquid is decreased, which allows the foamed material to supply the liquid in a wider area by utilizing capillarity.

For example, as PVA sponge, a sponge brush manufactured by Kanebo Trinity Holdings, Ltd. under a product name BELLCLEAN can be preferably used. Slurry can be uniformly painted on in a radial direction of a pad, by disposing the roll type BELLCLEAN sponge brush in the radial direction of the pad to cause the slurry to be gradually excluded out of the sponge brush.

As foamed polyurethane, a pad material manufactured by Nitta Haas Incorporated under a model number IC1000 can be used, for example. Also, a member such as a pad material under a model number Suba400 which has polyurethane impregnated in polyester fibers can be preferably used. Similarly, a pad material such as that under a model number Supreme which is of suede type can be preferably used.

In addition, not only the brush-like member but also a braided mesh member may be used. Slurry can be effectively painted on a pad surface by making the slurry impregnated in the mesh and causing the mesh to effectively act on the pad surface.

Figure 4:
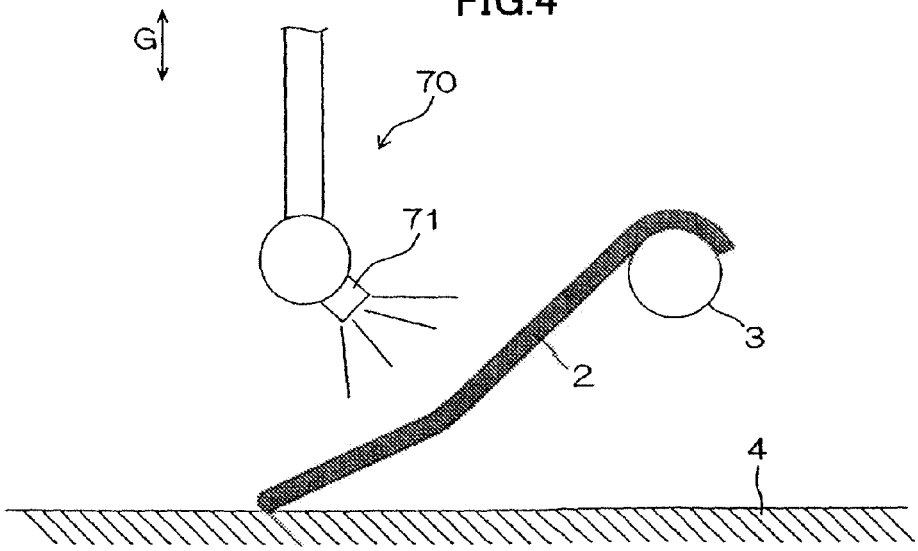
FIG. 4 is a side view showing a cleaning device for cleaning a polishing liquid supplying member.

Near the polishing liquid supplying device 1A, as shown in FIG. 4, there is provided a cleaning device 70 which cleans the polishing liquid remained on the polishing liquid supplying member 2 after polishing. The cleaning device 70 ejects pure water at a high pressure from a nozzle 71 to the polishing liquid supplying member 2 while moving in a direction shown by an arrow G. This makes the polishing liquid that is still remained on the polishing liquid supplying member 2 after polishing cleaned and removed from polishing liquid supplying member 2, which prevents any drying and adhering of the polishing liquid on the polishing liquid supplying member 2.

The polishing device 16 is configured as described above, thereby a chemical mechanical polishing of a wafer W is achieved by pressing the wafer W carried by the wafer carrier head 38A against the polishing pad 4 on the polishing table 34A, and supplying a polishing liquid S onto the polishing pad 4 by the polishing liquid supplying device 1A while the polishing table 34A and the wafer carrier head 38A are rotating. The wafer carrier head 38B, the polishing tables 34B and 34C, and the polishing liquid supplying devices 1B and 1C on the other side are configured in the same way.

Figure 5:
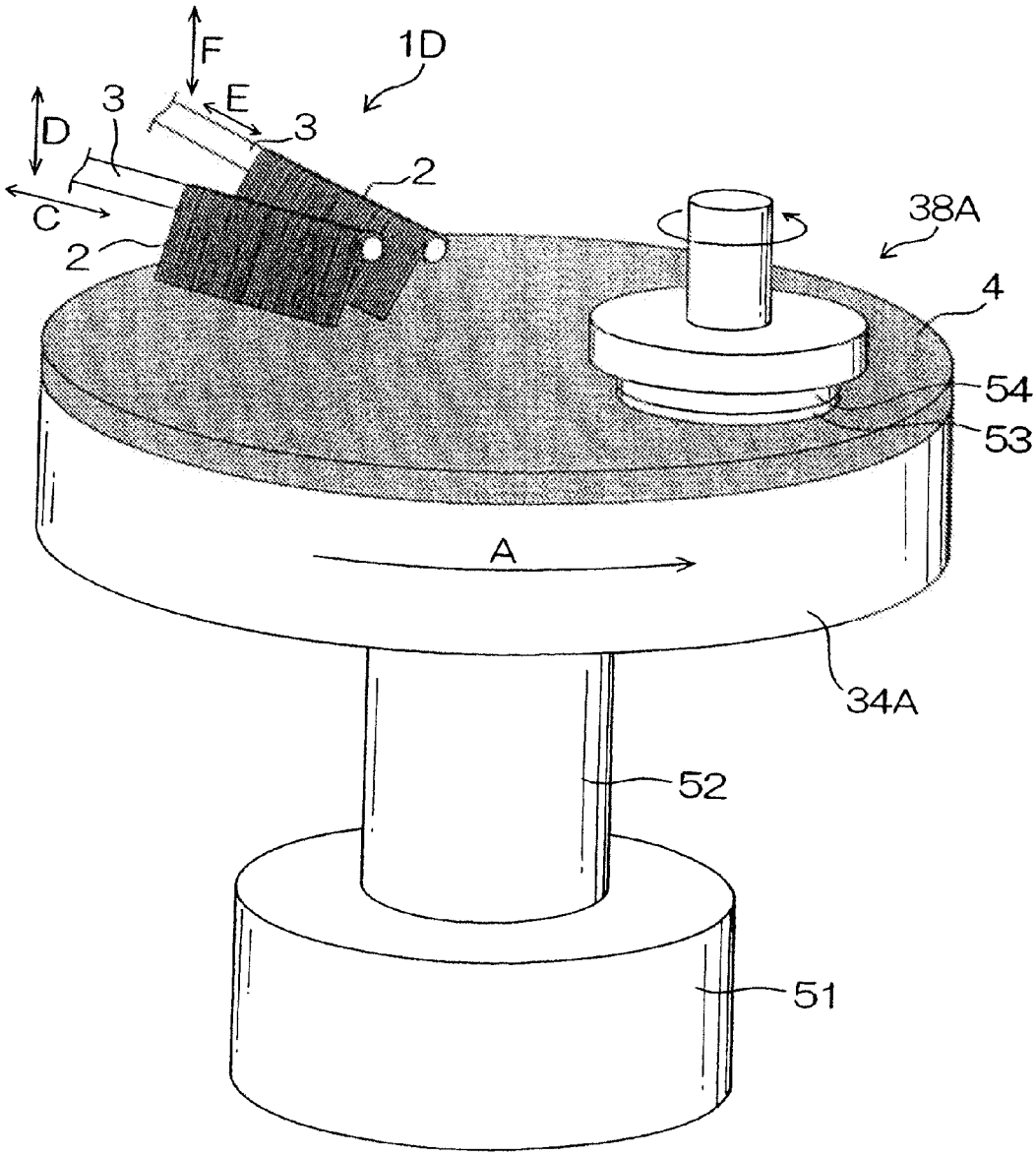
FIG. 5 is a perspective view showing a configuration of polishing device having a plurality of polishing liquid supplying members.

The polishing liquid supplying devices 1A may include a plurality of polishing liquid supply tubes 3 and polishing liquid supplying members 2 in parallel, as in the case of the polishing liquid supplying device 1D shown in FIG. 5. Since the plurality of polishing liquid supplying members 2 supply polishing liquids while individually moving in a direction shown by an arrow C, in a direction shown by an arrow D, in a direction shown by an arrow E, and in a direction shown by an arrow F, the areas to which the polishing liquids are supplied are increased, resulting in that the polishing liquid can be uniformly painted on the polishing pad with higher reliability.

The polishing liquid supplying member 2 is not limited to the plate-like member in which a groove is formed or the brush-like member which is formed of a plurality of thread-like members, and preferably may be a member which is formed by binding a plurality of fine tubular members, or an accordion member which is formed of a folded thin sheet member.

As shown in FIG. 1, between the polishing tables 34A, 34B, and 34C, two carrier cleaning units 40A and 40B are provided at the predetermined delivery positions TA and TB of the transport units 36A and 36B, respectively. The carrier cleaning units 40A and 40B clean carriers of the polishing heads 38A and 38B after polishing.

The cleaning and drying device 18 cleans a wafer W after polishing. The cleaning and drying device 18 includes a cleaning device 68A and a drying device 68B. The cleaning device 68A has three cleaning tanks which are used for alkaline cleaning, acid cleaning, and rinsing, respectively. After polishing by a polishing device 16, the wafer W is transported to the cleaning and drying device 18 by a transfer robot 30, where the wafer W is subject to acid cleaning, alkaline cleaning, or rinsing by the cleaning device 68A and dried by the drying device 68B. The dried wafer W is taken out of the drying device 68B by the indexing robot 22 of the transporting device 14, and is stored at a predetermined position in a cassette 24 which is set in the wafer housing section 20.

Polishing of a wafer is performed by an apparatus which is configured as described above.

In order to dispose the polishing liquid supplying member 2 at a close distance from the polishing pad 4 in which no droplet of the polishing liquid is formed at the tip end of the polishing liquid supplying member 2, the specific distance can be calculated by a method described below. For example, a droplet which falls from a circular tube having an outer diameter of 5 mm is assumed. Water has a surface tension of 72.8 mN/m at a temperature of 20° C. The droplet having an outer diameter of 5 mm has an outer circumferential length of about 15.7 mm. Under the condition of water having the surface tension of 72.8 mN/m acting on the length of 15.7 mm, a stress of 1.14 mN is required to hold on the water droplet against the gravity. With a gravitational acceleration of 9.8 $m/s^2$, the held water droplet has a weight of 0.117 g. The weight corresponds to a volume of 117 $mm^2$, from which a radius of the water droplet can be calculated to be about 3 mm. That is, the droplet which falls from a circular tube having an outer diameter of 5 mm has a diameter of 6 mm. Therefore, between a lower surface of the circular tube having an outer diameter of 5 mm and a lower surface of the droplet, a droplet having a radius on the order of 3 mm to 4 mm is produced. This means, as for water, the close distance according to the present invention will be on the order of 3 mm to 4 mm from the polishing pad 4. Similarly as for other polishing liquids, a close distance can be calculated from a radius of a droplet to be held by using a value of surface tension.

Figure 6:
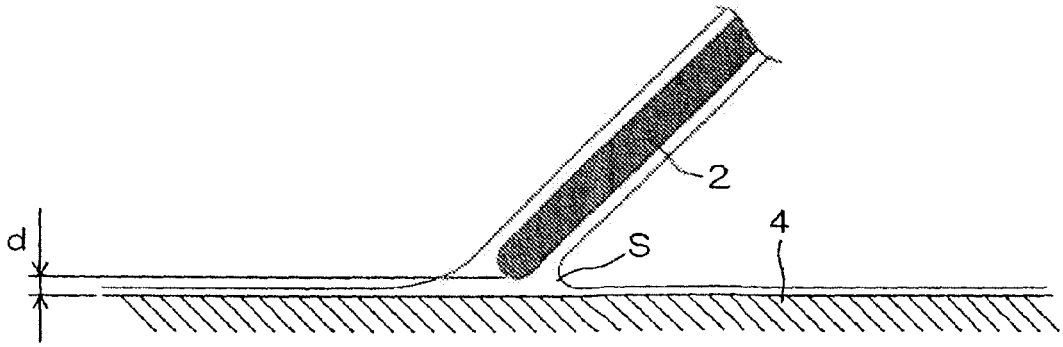
FIG. 6 is a cross sectional view showing a polishing liquid supplying member close to a polishing pad in polishing.
Figure 7:
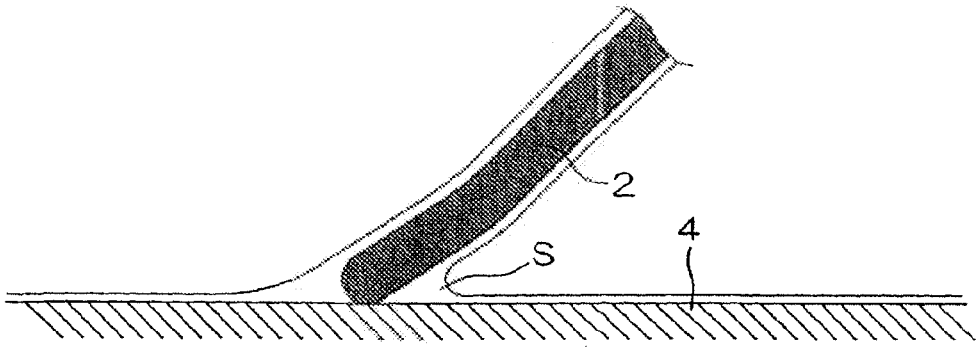
FIG. 7 is a cross sectional view showing a polishing liquid supplying member in contact with a polishing pad in polishing.

Next, a wafer polishing method according to the present invention will be explained below. FIG. 6 and FIG. 7 are cross sectional views showing a tip end of the polishing liquid supplying member 2 during polishing.

Upon a start of polishing, as the wafer carrier head 38A moves in the direction shown by the arrow B, a wafer which is adsorbed and immobilized on the wafer carrier head 38A shown in FIG. 1 is pressed against the polishing pad 4 which is rotating in the direction shown by the arrow A.

The polishing liquid supplying device 1A moves in the direction shown by the arrow D to bring the tip end thereof close to or in contact with the polishing pad 4, and also supplies a polishing liquid such as slurry or chemical to the polishing liquid supply tube 3 which is remained parallel to the polishing pad 4 by the tilt sensor 6 so that the polishing liquid can be uniformly supplied from the slit 5 to the upper portion of the polishing liquid supplying member 2. After being uniformly supplied to the upper portion of the polishing liquid supplying member 2, the polishing liquid flows down along the polishing liquid supplying member 2.

As shown in FIG. 6, when the polishing liquid supplying member 2 is close to polishing pad 4 with being separated by a distance d in which no droplet of the polishing liquid is formed due to surface tension of the polishing liquid, the polishing liquid S flowing down along the polishing liquid supplying member 2 uniformly spreads over the polishing pad 4 without forming a droplet due to interfacial tension which is acting between the polishing pad 4 and the polishing liquid supplying member 2.

Also, as shown in FIG. 7, when the polishing liquid supplying member 2 is in contact with polishing pad 4, the polishing liquid S flowing down to the polishing pad 4 uniformly spreads over the polishing pad 4 due to interfacial tension which is acting between the polishing pad 4 and the polishing liquid supplying member 2.

In this state, when the polishing liquid supplying device 1A moves in the direction shown by the arrow C in FIG. 1, the polishing liquid S is uniformly painted on the polishing pad 4 as the polishing pad 4 rotates. Thus, the polishing liquid S, even in a small amount, is uniformly painted on the polishing pad 4, resulting in that a polishing of a wafer is achieved at low cost with high accuracy without causing any problem such as scratch to a wafer surface to be polished. The wafer carrier head 38B, the polishing tables 34B and 34C, and the polishing liquid supplying devices 1B and 1C on the other side operate in the same way.

The flexible polishing liquid supplying member 2 can brush the surface of the polishing pad 4 and remove polishing residues including pad debris, coarse abrasive grains, polishing debris, or the like remained on the surface of the polishing pad, by adjusting a contact pressure applied to the flexible polishing liquid supplying member 2.

Figure 8:
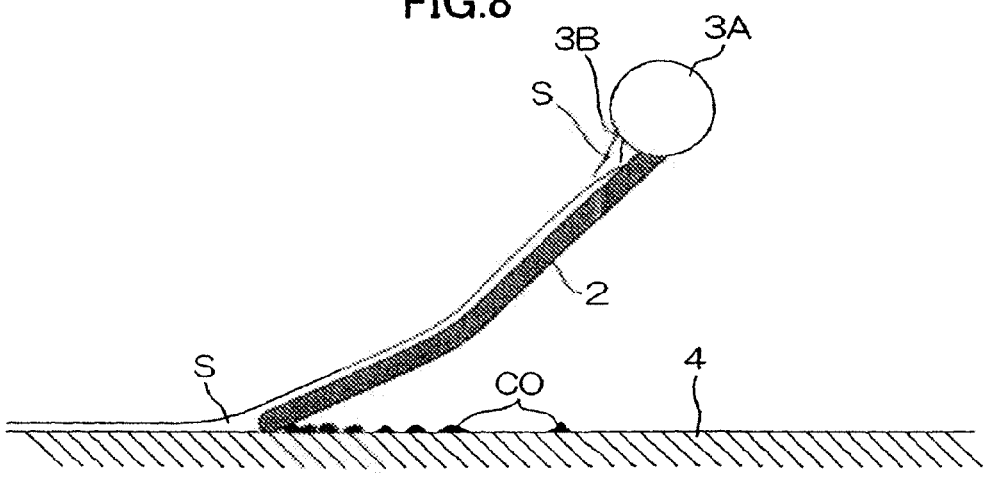
FIG. 8 is a side view showing a polishing liquid supplying member in cleaning a polishing pad.

In this way, as shown in FIG. 8, the polishing liquid S flows from a polishing liquid supply port 3B of the polishing liquid supply tube 3A only onto the upper portion of the polishing liquid supplying member 2, to be painted on the polishing pad 4, and also polishing residues CO is removed by using the lower portion of the polishing liquid supplying member 2 so that new slurry can be uniformly painted on the surface of the polishing pad 4 which has been cleaned by the polishing liquid supplying member 2.

Figure 9:
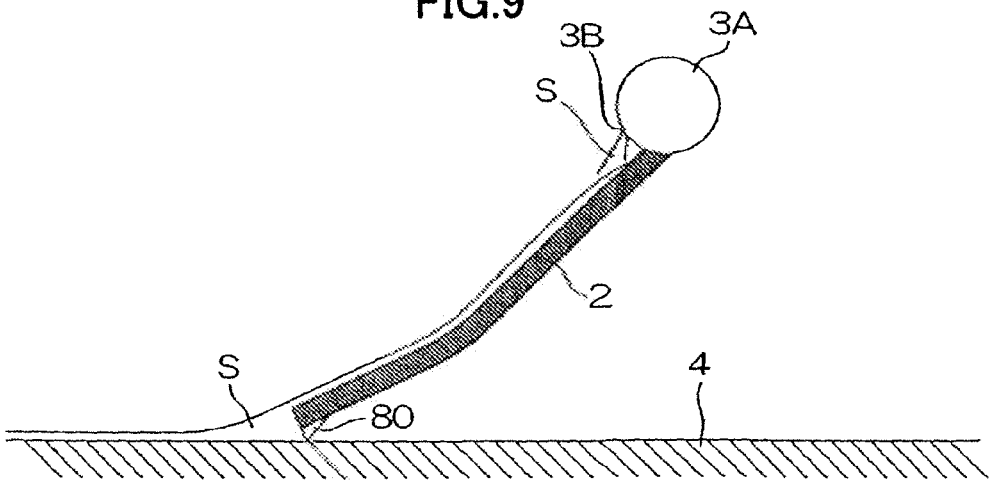
FIG. 9 is side view showing a polishing liquid supplying member in dressing a polishing pad.
Figure 10A:
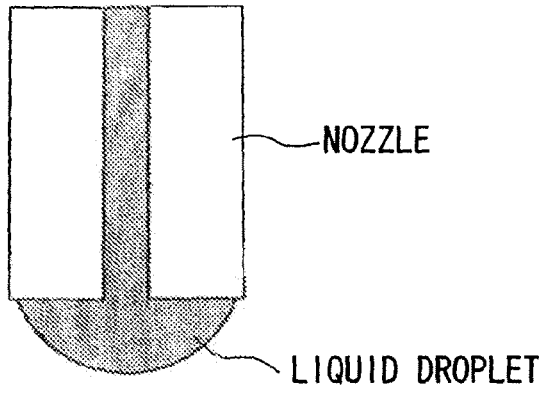
FIGS. 10A to 10C are side views illustrating a droplet which falls from a tip end of a nozzle.
Figure 10B:
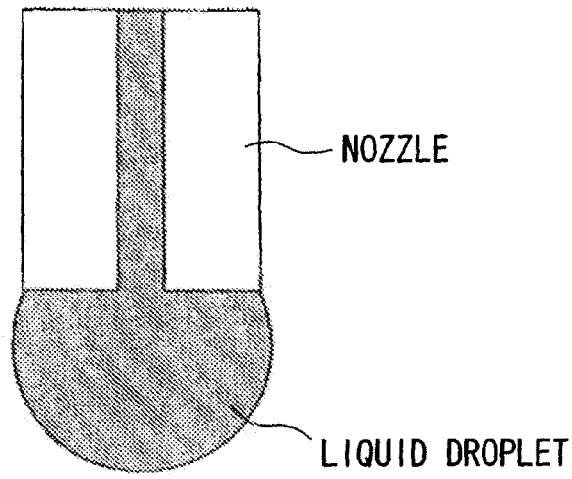
Figure 10C:
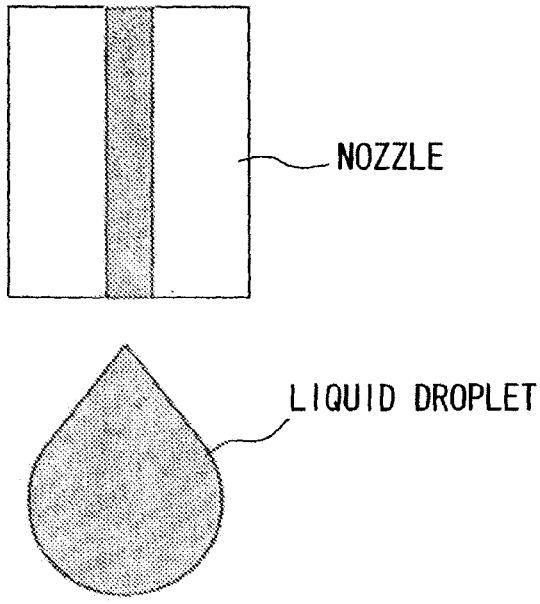
Figure 11A:
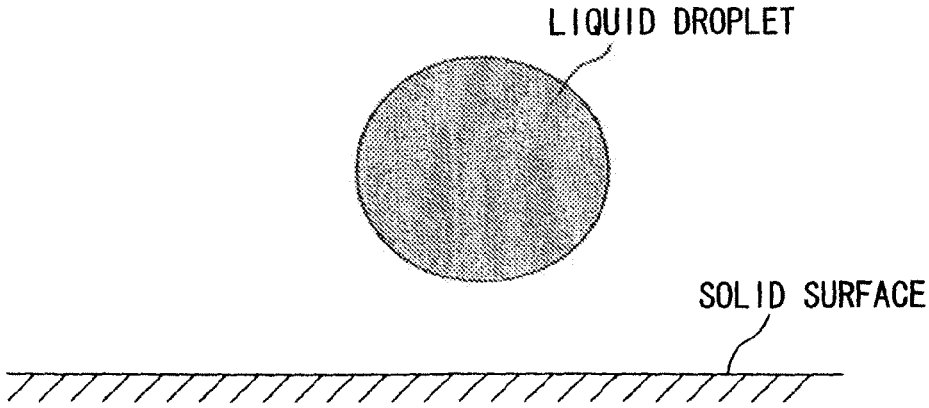
FIGS. 11A to 11B are side views showing states of a polishing liquid which spreads out on a solid surface.
Figure 11B:
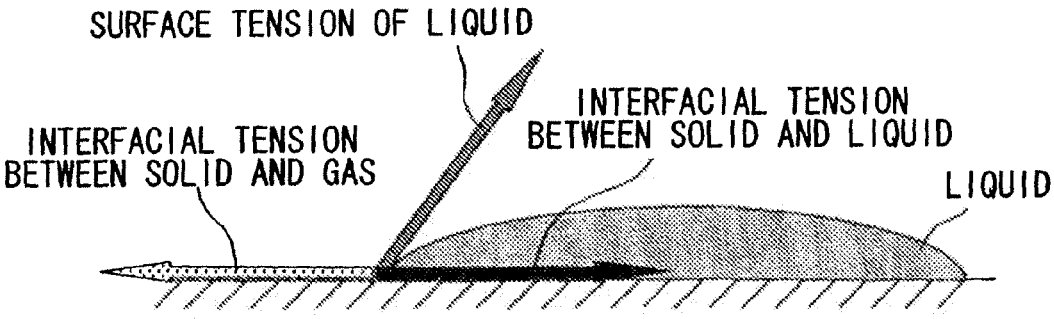

As shown in FIG. 9, the polishing liquid supplying member 2 is provided with a pad dresser 80 for dressing of the polishing pad 4 at the tip end thereof, and this enables a dressing of the polishing pad 4 to be performed during a new polishing liquid is supplied only on the upper surface of the polishing liquid supplying member 2 from the polishing liquid supply port 3B of the polishing liquid supply tube 3A, so that the new polishing liquid can be uniformly painted on a new surface of the polishing pad 4 which has been dressed by the polishing liquid supplying member 2.

As described above, supplying of a polishing liquid S, cleaning of the polishing pad 4, and dressing of the polishing pad 4 are performed at the same time, and a polishing of wafer is performed by using a new surface of the polishing pad 4 which is being consistently dressed by supplying a polishing liquid which does not include any polishing residues, thereby throughput is improved and an accurate polishing can be achieved without causing any problem such as scratch to a wafer surface to be polished.

If the pad dresser 80 is provided to the polishing liquid supplying member 2, the dressing apparatuses 35A, 35B, and 35C will be eliminated.

Now, a comparison between a result of polishing a wafer by using a wafer polishing method according to the present invention and a result of polishing a wafer by using a conventional wafer polishing method is shown below. The polishing apparatus was a mass product CMP apparatus by Tokyo Seimitsu Co., Ltd. (brand name: ChaMP322).

Condition for polishing was set as follows:

| | |
|---|---|
| Wafer Pressure | 3 psi |
| Retainer Pressure | 1 psi |
| Number of Rotation of Polishing Pad | 80 rpm |
| Number of Rotation of Carrier | 80 rpm |
| Slurry Supplying Rate | 100 ml/min |
| Polishing PadIC | 1400-Pad D30.3 (by Nitta Haas Incorporated) |
| Polishing Period | 60 sec |
| Air float flow rate | 49 L/min |
| Slurry (Polishing Liquid) | Fumed Silica Slurry SS25 (1:1 diluted with water) (Cabot Corporation) |
| Wafer | 12 inch wafer with oxide film (PETEOS on Si) |
| Dressing Method | In-situ dressing |
| Dressing Power | 4 kgf (4 inch dresser, Mitsubishi Materials Corporation) |
| Dressing swing cycle | 1 times/10 sec |
| Number of Rotation of Dresser | 88 rpm |

As a conventional polishing liquid supplying device, a PFA tube was mounted to the upper portion of the polishing pad. The PFA tube had a diameter of 6 mm, and delivered slurry as a polishing liquid by drops to a position which was located 50 mm from the center of the polishing pad.

In the polishing liquid supplying device of the present invention, the polishing liquid supplying member was disposed to be in contact with the polishing pad between a position at 90 mm and a position at 330 mm from the center of the polishing pad. The polishing liquid supplying member had been formed of about 1000 to 2000 of nylon fibers having a diameter of 0.1 mm to 0.2 mm which were lined up along a longitudinal direction of the polishing liquid supply tube (in a radial direction of the polishing pad).

The polishing pad was attached to a polishing table, and after being dressed for 30 minutes with a supply of pure water, polished 25 wafers with a conventional configuration under the above condition, by dropping slurry at a position located 90 mm from the center of the polishing pad at a supply rate of 300 ml/min. When the polishing was completed, it was checked if a polishing rate of wafers was equal to a predetermined value of 2800 A/min or more to adjust the state of the polishing pad.

In the adjusted state, wafers were polished by using a conventional configuration and a wafer polishing method according to the present invention. Since each polishing was serially performed after an exchange of polishing liquid supplying devices, the other conditions including the state of the polishing pad and the pressure against the wafer were identical except the polishing liquid supplying devices.

Figure 12A:
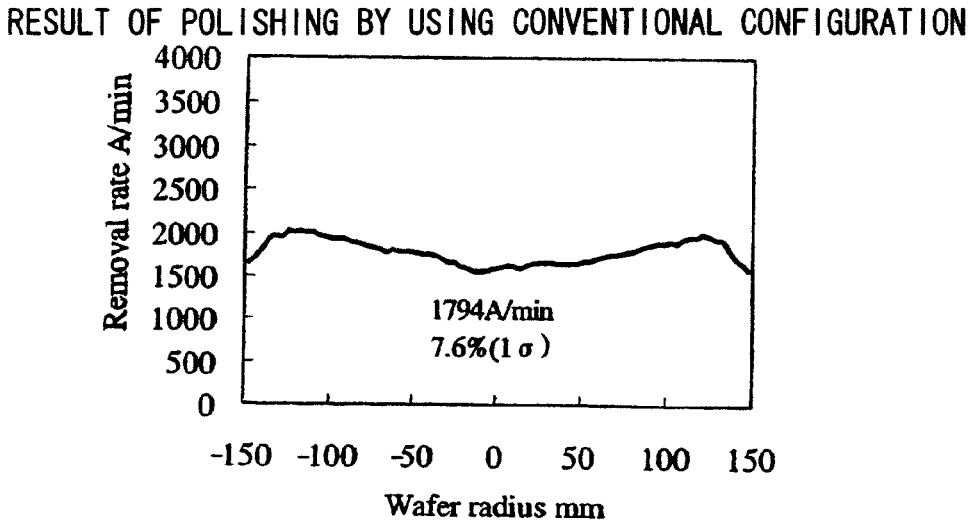
FIGS. 12A and 12B are graphs showing results of polishing by using a conventional configuration and a wafer polishing method according to the present invention.
Figure 12B:
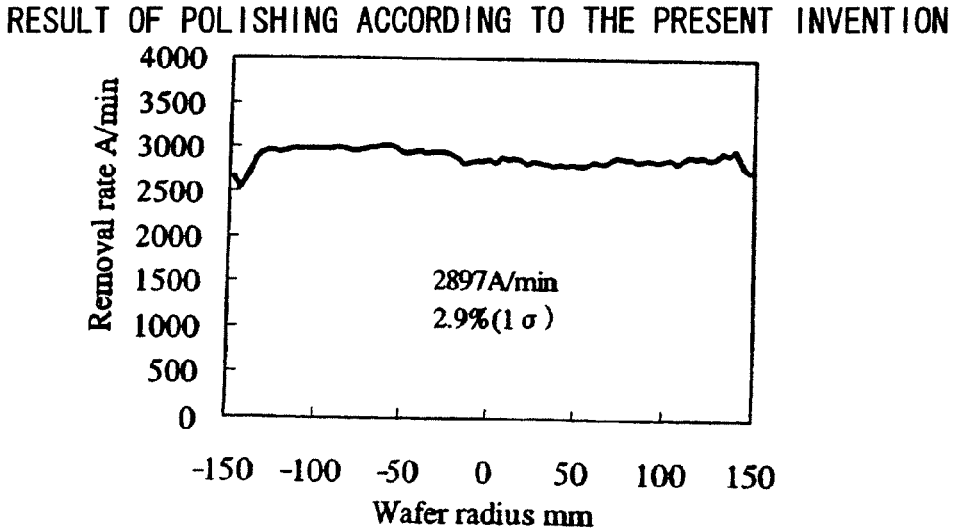

The results of polishing are shown in FIGS. 12A and 12B. The results show that, when a conventional configuration was used, because slurry was supplied only at one position located 50 mm from the center of the polishing pad, the slurry in an amount of 100 ml/min could not be spread over the entire wafer. It can be said that that is because the slurry, which was supposed to be painted on a surface of the polishing pad via grooves in a surface of the polishing pad and was in a small amount, was spread in the grooves and didn't reach the upper surface of the polishing pad. This caused a general shortage of the slurry, and consequently lowered a polishing rate to 1794 A/min. A polishing was made in a center slow manner in which the polishing rate was slower at the center portion of a wafer, and in-plane uniformity was degraded to 7.6%.

To the contrary, when a wafer polishing method according to the present invention was used, an extremely high polishing rate of 2897 A/min was yielded, and in-plane uniformity was improved up to 2.9%. This is because slurry flowed down along the polishing liquid supplying member to be selectively painted only onto the surface of the polishing pad, not in the grooves formed in the polishing pad, and most of the supplied slurry was involved in the polishing.

As seen from the above explanation, according to the present invention, a polishing liquid, even in an extremely small amount, can be uniformly painted on an entire surface of a polishing pad, and a high polishing rate can be maintained. Also, the present invention is effective in achieving in-plane uniformity of polishing. Thus, a minimum polishing liquid will be consumed, and operation cost for mass production will be reduced.

As described above, according to a wafer polishing apparatus and a wafer polishing method of the present invention, a polishing liquid supplying member having a simple configuration allows a polishing liquid, even in a small amount, to be uniformly painted on a polishing pad by using interfacial tension of the polishing liquid. This enables a polishing of a wafer to be performed at low cost with high accuracy without causing any problem such as scratch to a wafer surface to be polished.

In addition, a uniform supply of a polishing liquid over a polishing pad allows a high polishing rate to be maintained, and also is effective in achieving in-plane uniformity of polishing, resulting in that a minimum polishing liquid will be consumed, and operation cost for mass production will be reduced.

Furthermore, because supplying of a polishing liquid, cleaning of the polishing pad, and dressing of the polishing pad can be performed at the same time, a high throughput and high accuracy polishing of a wafer can be achieved.

What is claimed is:

1. A wafer polishing method, comprising the steps of:

positioning one or more polishing liquid supplying members that are elongated in a widthwise direction extending in a radial direction from a central portion toward a peripheral edge portion of a polishing pad by an amount equal to about 79% of the diameter of an area of a wafer carrier head for holding a wafer being polished on the polishing pad in a state in which a lower end of the supplying member is close to or in contact with a polishing pad which polishes a wafer and relatively moving the polishing liquid supplying member against the polishing pad, the polishing liquid supplying member being formed of or a brush-like member which is formed by binding a plurality of thread-like members in series in the widthwise direction in order to make the polishing liquid uniformly flow down along the polishing liquid supplying member by an effect of capillarity; and supplying a polishing liquid to an upper portion of the polishing liquid supplying member so that the polishing liquid flows down along polishing liquid supplying member onto a surface of the polishing pad for polishing the wafer as the polishing pad is rotated.

2. The wafer polishing method according to claim 1, further comprising the step of:

removing polishing residues on the polishing pad by the polishing liquid supplying member in contact with the polishing pad, during the step of supplying a polishing liquid to an upper portion of the polishing liquid supplying member so that the polishing liquid flows down along polishing liquid supplying member onto a surface of the polishing pad.

3. The wafer polishing method according to claim 1, further comprising the step of:

dressing the polishing pad by a pad dresser which is provided to the polishing liquid supplying member at a portion where the polishing liquid supplying member is in contact with the polishing pad for dressing the polishing pad, during the step of supplying a polishing liquid to an upper portion of the polishing liquid supplying member so that the polishing liquid flows down along polishing liquid supplying member onto a surface of the polishing pad.

4. A method for polishing a wafer by using:

a polishing pad to which a polishing liquid is supplied and which polishes the wafer while being moved relatively to the wafer, a carrier head to carry the wafer, and a brush-shaped member which is formed by binding a plurality of thread-like members extending in vertical direction from a liquid supplying member that is elongated in a widthwise direction thereof, the thread-like members being arranged in series in the widthwise direction in order to make the polishing liquid uniformly flow down along the polishing liquid supplying member by an effect of capillarity, and a lower end of which is close to or in contact with a surface of the polishing pad, the method comprising:

supplying the polishing liquid to an upper portion of the brush-like member which is positioned extending generally radially relative to the polishing pad with the width of the liquid supplying member extending from a central portion toward a peripheral edge portion of the polishing pad in radial direction by an amount equal to about 79% of the diameter of an area of a wafer carrier head for holding a wafer being polished on the polishing pad and with the liquid supplying member extends widthwise along the length of the liquid supplying tube, the polishing liquid flowing down along the brush-shaped member to the lower end thereof, and supplying the supplied polishing liquid from the lower end of the brush-like member to the surface of the polishing pad while moving the polishing pad relative to the supplying member as the polishing pad rotates.

5. The method for polishing a wafer according to claim 4, wherein the brush-like member is in contact with the polishing pad to remove polishing debris on the polishing pad.

6. The method for polishing a wafer according to claim 4, wherein the brush-like member is provided with a pad dresser for dressing the polishing pad at a portion contacting the polishing pad to dress the polishing pad, and the polishing liquid supplied to the upper portion of the brush-like member is supplied from the lower end of the brush-like member to the polishing pad.

7. The method for polishing a wafer according to claim 4, wherein the polishing pad has a polishing surface which polishes the wafer and a part which is positioned lower than the polishing surface.

8. The method for polishing a wafer according to claim 7, wherein the brush-like member supplies the polishing liquid, supplied from the supplying device, from the lower end of the brush-like member only to a polishing surface which is a surface of the polishing pad.

* * * * *